US005457911A

United States Patent [19]

Vollink

[11] Patent Number: 5,457,911

[45] Date of Patent: Oct. 17, 1995

[54] FENCE MOUNTED HANGER

[75] Inventor: Dan H. Vollink, Whitehall, Mich.

[73] Assignee: Dec-Kor, Inc., Whitehall, Mich.

[21] Appl. No.: 93,401

[22] Filed: Jul. 19, 1993

[51] Int. Cl.[6] ..... A01G 9/02; A47G 7/02

[52] U.S. Cl. ..... 47/67; 47/39; 248/303; 248/318; 248/225.21

[58] Field of Search ..... 47/67, 39, 71; 248/217.2, 218.2, 225.2, 312.1, 303, 318

[56] References Cited

U.S. PATENT DOCUMENTS

| | | | |
|---|---|---|---|
| 258,330 | 2/1981 | Bosley . | |
| 800,585 | 9/1905 | Maxam | 248/225.2 |
| 928,195 | 7/1909 | Henderson . | |
| 1,566,982 | 12/1925 | Shee . | |
| 1,663,366 | 3/1928 | Berry . | |
| 1,913,587 | 5/1933 | Edwards . | |
| 2,235,986 | 3/1941 | Ellingson . | |
| 2,471,309 | 5/1949 | Chandler . | |
| 2,764,384 | 9/1956 | Kirsch | 248/303 |
| 2,770,957 | 11/1956 | Bronson | 47/71 |
| 2,949,510 | 8/1960 | Sichel | 248/303 |
| 4,109,415 | 8/1978 | Hall | 47/67 |
| 4,524,542 | 6/1985 | Elliott . | |
| 4,603,507 | 8/1986 | Nelson . | |
| 4,666,115 | 5/1987 | Schiro . | |
| 5,060,809 | 10/1991 | Bayes et al. | 248/303 |

FOREIGN PATENT DOCUMENTS

| | | | |
|---|---|---|---|
| 1236580 | 6/1960 | France | 47/67 |
| 239758 | 3/1979 | France . | |
| 258946 | 6/1912 | Germany . | |
| 84150 | 10/1919 | Germany | 47/67 |
| 924284 | 2/1955 | Germany | 47/67 |
| 0621935 | 3/1981 | Switzerland | 47/67 |
| 17666 | of 1902 | United Kingdom | 248/303 |

*Primary Examiner*—David J. Bagnell
*Assistant Examiner*—Joanne C. Downs
*Attorney, Agent, or Firm*—Price, Heneveld, Cooper, DeWitt & Litton

[57] ABSTRACT

The specification discloses a hanger assembly for suspending potted plants or similar ornamentation from chain-link, lattice, or similar type fencing. The device includes an object support member, attached by means of an integral tooth to a U-shaped support rod, the free ends of which are bent to form fence-engaging hooks.

30 Claims, 4 Drawing Sheets

FENCE MOUNTED HANGER

BACKGROUND OF THE INVENTION

The present invention relates to devices for supporting potted plants and similar ornamentation from a variety of fences, including chain-link, lattice and the like.

There is no common method which addresses the need to support plants or like ornamentation from chain-link and other open-type fences. Rather, the prior art discloses methods for suspending plants from ceilings, walls, privacy-fences, and similar substantially solid support structures. For example, U.S. Pat. No. 4,524,542 describes a hanging-plant holder designed to be suspended from a brick ledge, wall, or the like. The device does use both one-piece object support and wall-engaging members, but permits neither the accommodation of non-hanging plants or the attachment of the entire unit to chain-link or similar type fencing. U.S. Pat. No. 1,566,982 discloses a flower holder for mounting to the side of a crypt. This invention requires that at least the top, supporting portion of the holder be securely fastened to a crypt with a metal bracket and screw assembly. Yet another design, U.S. Pat. No. 4,666,115 describes a method for suspending hanging plants requiring that the supporting fence consists of a number of parallel, vertical slats. The invention attaches to the fence between adjacent slats, while an attached, canted support arm rests against the flat surface of both flanking slats. Finally, U.S. Pat. No. 4,603,507 discloses a one-piece, potted plant holding unit designed to be grouped in a series of continuous, suspended potted plant holders. Unlike the above indicated prior art, this device requires an overhead mount such as a ceiling hook, overhead pipe, or the like.

SUMMARY OF THE INVENTION

The present invention is a hanger for potted plants and like ornamentation, designed to be suspended from a variety of fence-types, having a generally U-shaped, fence-engaging support rod connected to an object support member capable of accommodating a variety of pot sizes. The hanger is mounted by placing the hook ends of the support rod over the length of a chain-link or similar fence, the object supporting member resting against the fence and extending generally laterally from the "U" shaped support rod. Each of the fence-engaging support rod and the object support member can be made of a one-piece construction which permits their inexpensive manufacture and simple assembly. The entire hanger unit is likewise designed to be attached and removed from any contemplated fence-type without damaging either the fence or the hanger.

These and other objects and advantages of the invention will be more fully understood and appreciated by reference to the drawings and the detailed description of the preferred embodiment set forth below.

DESCRIPTION OF THE PREFERRED EMBODIMENT

Figure 1:
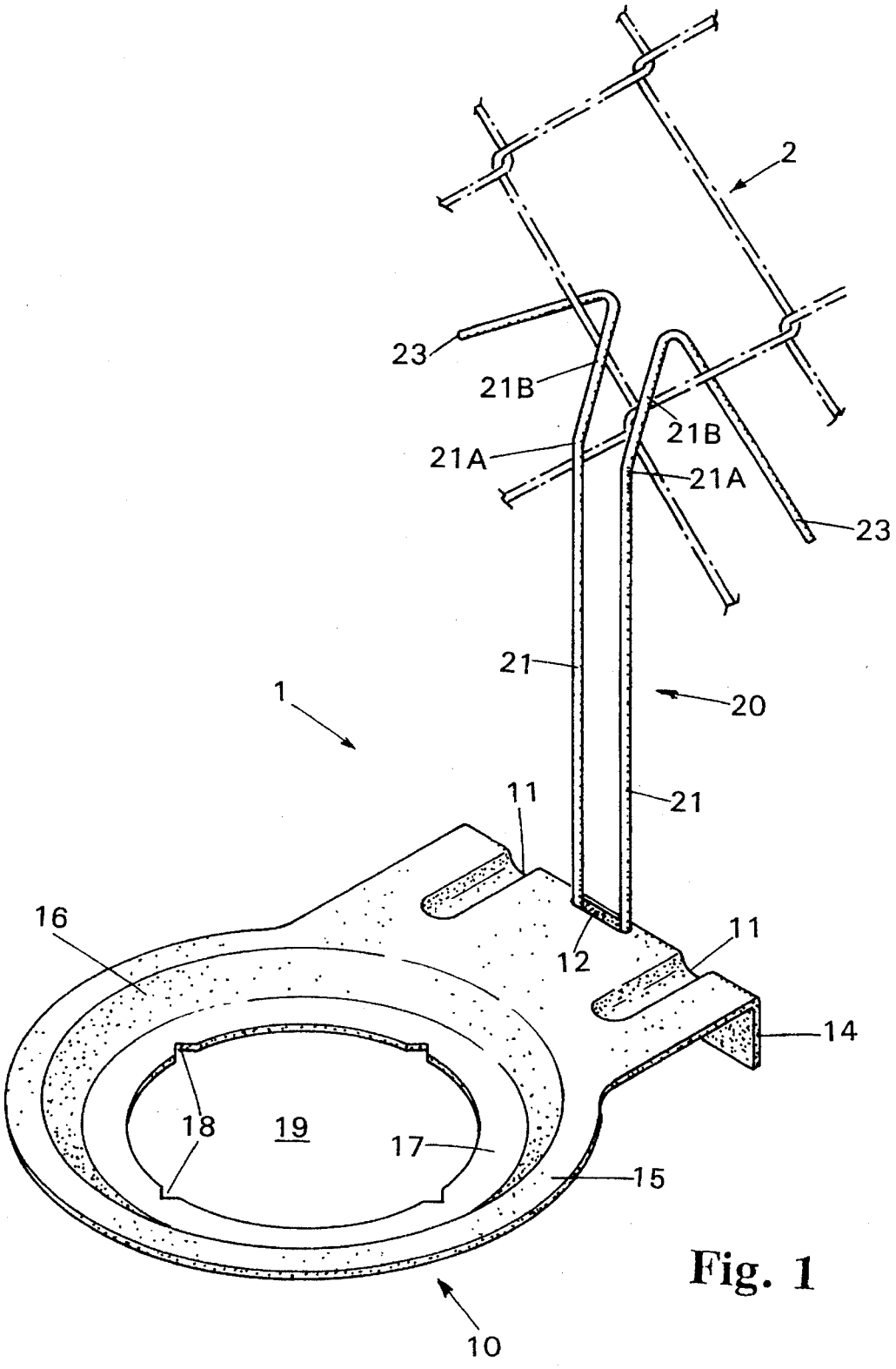
FIG. 1 shows a perspective view of the hanger assembly engaging a chain-link fence.

As shown in FIG. 1, the preferred embodiment of hanger assembly 1 includes an object support member 10 and a support rod 20, hooked beneath a tooth 13 (FIGS. 5, 6, and 7) integral to support member 10 and projecting away from the fence-abutting wall 14 of support 10.

Figure 3:
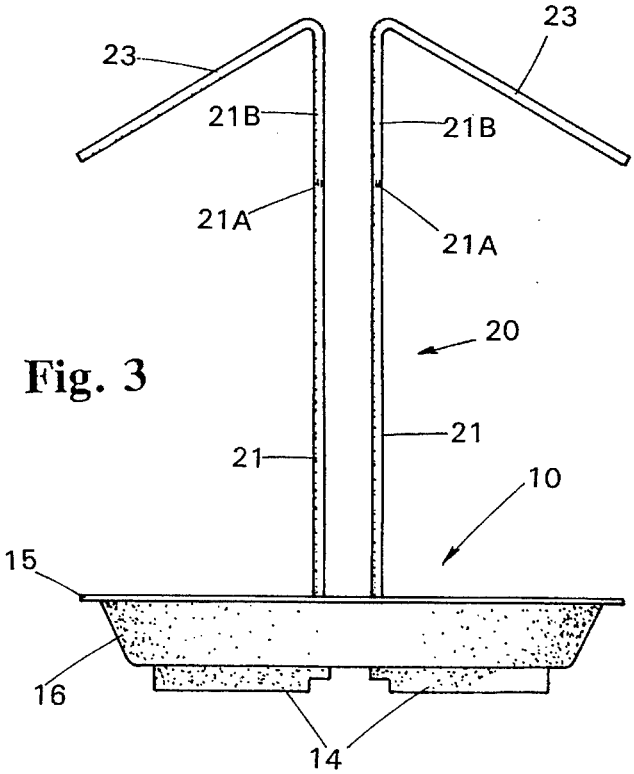
FIG. 3 depicts a frontal elevation of the entire hanger assembly.
Figure 4:
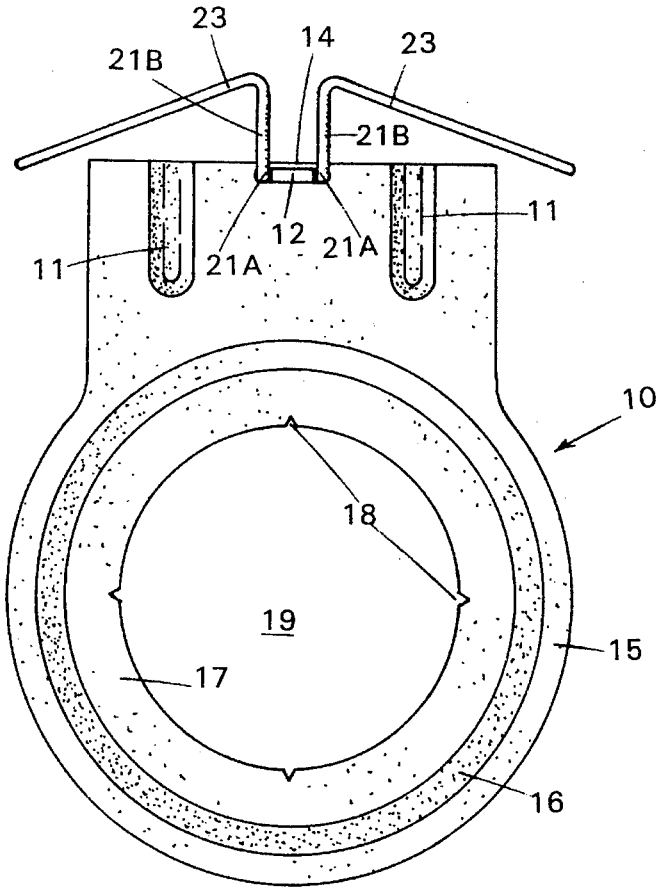
FIG. 4 is a top plan view of the hanger assembly.
Figure 5:
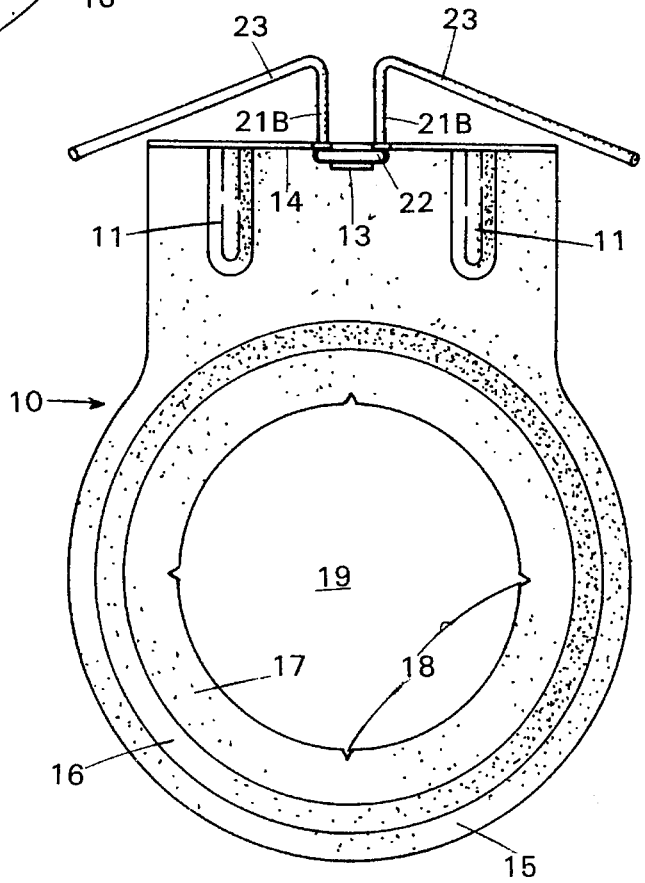
FIG. 5 is a bottom plan view of the hanger assembly.
Figure 6:
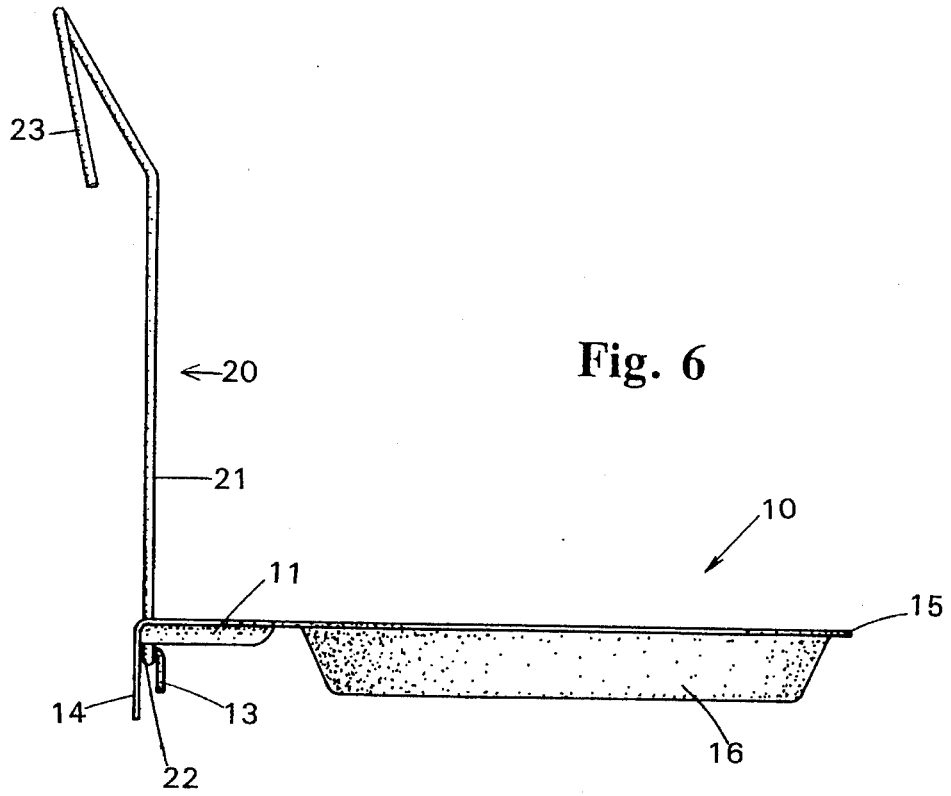
FIG. 6 is a right side elevation of the hanger assembly.

Support rod 20 (FIGS. 2 and 3), ideally constructed from a single piece of metal wire, is generally U-shaped, with a support-member connecting bite 22 and two parallel arms 21 bent at their "free" ends to form fence-engaging hooks 23 (FIGS. 4 and 6). Each leg 21 is first bent rearwardly at 21*a* (i.e., rearwardly as viewed in FIG. 1) at approximately 30° from the vertical to define a rearwardly sloping upper leg portion 21*b* (FIGS. 1, 4, 5, 6 and 7), and is then bent laterally outwardly and downwardly to about 60° from the vertical, and back forwardly to define the downwardly and forwardly angled hook 23. Each of the hooks bends away from its counterpart on the adjacent leg 21. Hooks 23 are not bent back to the plane of upper legs 21*b*, but rather is bent slightly more toward the vertical. At the ends of hooks 23, there is about a one-half inch (½") gap between the plane of legs 21*b* and the plane of hooks 23. This helps "seat" the wire form in notches, V-grooves, and the like and cause the butt-end of wire form 23 to dig into the back side of wood privacy fences (normally 1" thick).

Object support member 10, as seen in FIGS. 4 and 5, preferably has a generally dish-shaped configuration, including an outer rim 15, a downwardly and inwardly sloping annular wall 16, and an inner rim 17 having several V-shaped drainage notches 18, and a circular opening 19, the combination of said structures being suitable for accommodating pots of various sizes. The diameters of opening 19, the outer diameter of inner rim 17 and the outer diameter of the top of annular sloped wall 16 are 3 inches, 4 inches and 4½ inches respectively to accommodate 3-inch, 4-inch, 5-inch and 6-inch pots.

Figure 2:
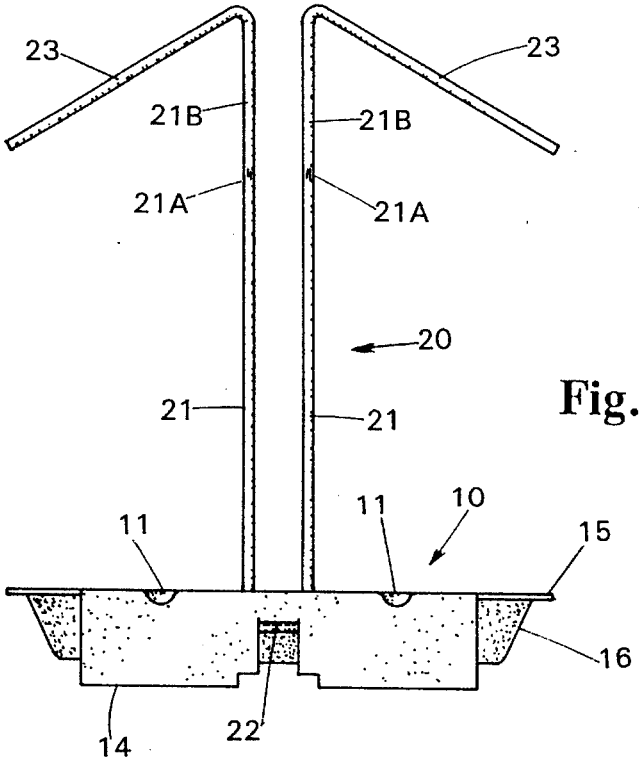
FIG. 2 illustrates a rear elevation of the entire hanger assembly.
Figure 7:
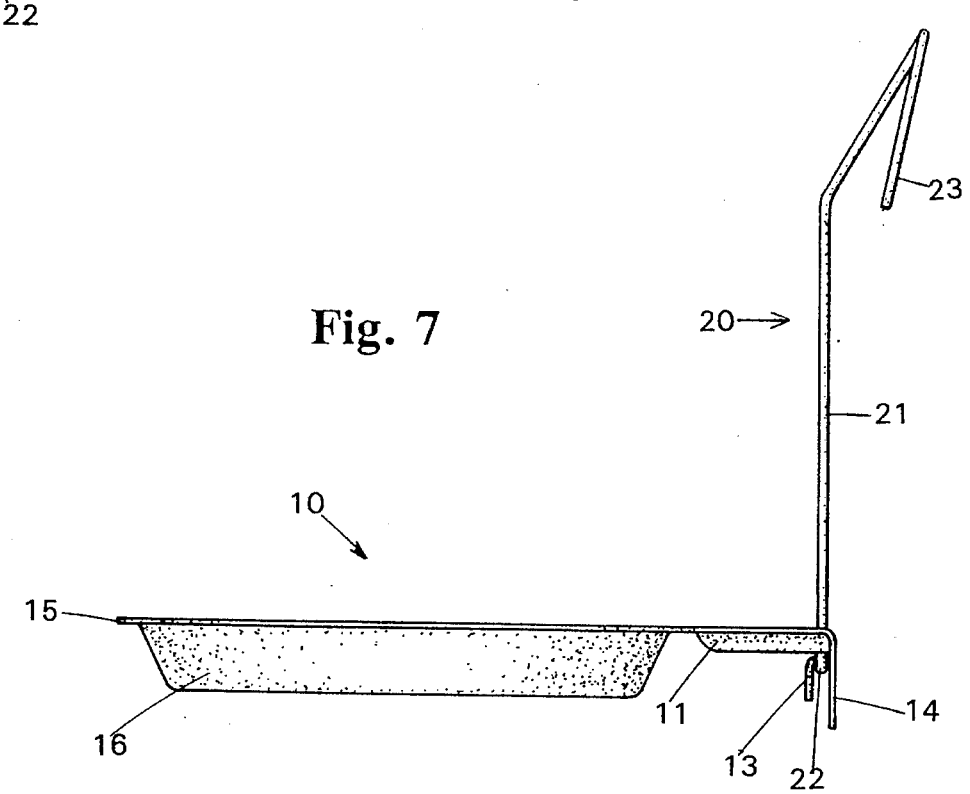
FIG. 7 is a left side elevation of the hanger assembly.

Object support member 10 also has two integral, structural reinforcing ribs 11. These ribs 11 flank support-rod connecting slot 12 (FIGS. 1 and 4). Ribs 11 serve not only to strengthen, but also to channel water and liquid fertilizers away from and off the face of object support 10. Also integral to support member 10, as depicted in FIGS. 2, 6 and 7, is fence-abutting wall 14, which extends downward from object support member 10 approximately perpendicular to the horizontal plane of outer rim 15, abutting the edges of the structural support ribs 11. Finally, the preferred embodiment of object support member 10 includes an integral tooth 13 protruding first inward from the fence-abutting wall 14 and then downward, generally parallel to said fence-abutting wall 14. The entire object support member 10 is stamped of a single piece of metal. To complete the entire hanging assembly 1 (FIG. 1), support rod 20 is attached to and suspends object support member 10 from a fence by connecting tooth 13 (FIGS. 5, 6, and 7). Bite portion 22 of rod 20 is inserted down through slot 12 in support 10 and is passed beyond the tip of tooth 13. Bite 22 is then slipped in behind tooth 13 and is moved up relative to support 10 until bite 22 is seated against the base of tooth 13. Tooth 13 thus prevents rod 20 from being displaced from slot 12 (FIG. 4).

Hanging assembly 1 can be mounted to a chain-link, board or similar fence (FIG. 1, depicting a chain-link fence in "phantom" lines) by means of the angled hooks 23 of the support rod 20, which are placed behind the fence 2. Fence-abutting wall 14, as seen in FIG. 1, press against the fence 2, preventing the lateral motion of the suspended hanger assembly 1. Once mounted to a suitable fence, a plant or similar ornamentation may be placed either in or upon object support member 10 (FIG. 1). A pot, for example, placed upon inner rim 17 will abut downwardly sloping annular wall 16, preventing the pot from sliding off object support member 10. If, in the alternative, a pot or similar ornamentation is placed in opening 19, inner rim 17 acts as a rest either for the lip of the pot, or the wall of the pot whose circumference prevents it from passing through opening 19.

Of course, it is understood that the above is merely a preferred embodiment of the invention and that various changes, alterations, and modifications, apparent to those skilled in the art, can be made without departing from the spirit and broader aspects thereof.

The embodiments of the invention in which an exclusive property or privilege is claimed are as follows:

1. A hanger-assembly for suspending potted plants or similar ornamentation from chain-link, lattice, privacy, or like fencing, comprising:

a generally U-shaped rod defined by spaced, upwardly extending legs joined at the bottom by a bite leg, said upwardly extending legs including lower leg portions lying generally in a vertical plane when said assembly is oriented in its intended use position, the upper end of each of said legs being bent rearwardly away from said vertical plane to define a rearwardly sloping upper leg portion, and then being bent laterally outwardly, downwardly and forwardly back towards said vertical plane to define a hook;

an object support member joined to said U-shaped rod at the bite leg thereof and extending generally forwardly and laterally away from said vertical plane of said upwardly extending lower leg portions.

2. The hanger-assembly of claim 1, wherein said object support member has a substantially dish-shaped configuration.

3. The hanger-assembly of claim 2, said substantially dish-shaped object support member being comprised of two spaced, concentric rims, one inner and one outer, connected by a downwardly sloping, annular wall.

4. The hanger-assembly of claim 3, said inner rim circumscribing a circular opening in the bottom of said substantially dish-shaped object support member.

5. The hanger-assembly of claim 4, said object support member having on said inner rim a series of spaced, V-shaped drainage notches which flank said circular opening.

6. The hanger-assembly of claim 5 in which said outer rim extends towards said bite leg of said rod in a generally fiat wall, said wall having spaced, parallel structural support ribs located therein.

7. The hanger-assembly of claim 6, said object support member being constructed of metal.

8. The hanger-assembly of claim 1 in which said upper end of each of said legs is bent rearwardly away from said vertical plane at an angle of approximately 30° to define said rearwardly sloping upper leg portion, and is then bent laterally outwardly and downwardly to about 60° from a plane extending through both said lower and said rearwardly sloping upper leg portions.

9. The hanger-assembly of claim 8 in which said hook extends forwardly at an angle of approximately 30° from said vertical plane.

10. A hanger assembly for suspending potted plants or similar ornamentation from chain-link, lattice, privacy or like fencing comprising:

a generally U-shaped rod defined by spaced, upwardly extending legs joined at the bottom by a bite leg, the upper end of each of said legs being bent into a hook;

an object support member including an object support surface, a wall extending downwardly from said object support surface, a tooth projecting away from said wall and downwardly beneath said object support surface;

an opening in said object support surface above said tooth;

said U-shaped rod extending through said opening with said bite leg being located beneath and behind said tooth to hold said object support member and said rod together.

11. The hanger-assembly of claim 10, wherein said object support member has a substantially dish-shaped configuration.

12. The hanger-assembly of claim 11, said dish-shaped object support member being comprised substantially of two spaced, concentric rims, one inner and one outer, connected by a downwardly sloping, annular wall.

13. The hanger-assembly of claim 12, said inner rim circumscribing a circular opening in the bottom of said substantially dish-shaped object support member.

14. The hanger-assembly of claim 13, said object support member having on said inner rim a series of spaced, V-shaped drainage notches which flank said circular opening.

15. The hanger-assembly of claim 11, said object support member having spaced, parallel structural support ribs located approximate to said wall.

16. The hanger-assembly of claim 10, said object support member having spaced, parallel structural support ribs located approximate to said wall.

17. The hanger-assembly of claim 10, said tooth in said object support member being integral with and formed from said wall.

18. The hanger-assembly of claim 17, said tooth in said object support member being bent inward from said wall, and then downward, generally parallel to said wall.

19. The hanger-assembly of claim 18, wherein said object support member has a substantially dish-shaped configuration.

20. The hanger-assembly of claim 19, said dish-shaped object support member being comprised substantially of two spaced, concentric rims, one inner and one outer, connected by a downwardly sloping, annular wall.

21. The hanger-assembly of claim 20, said inner rim circumscribing a circular opening in the bottom of said substantially dish-shaped object support member.

22. The hanger-assembly of claim 21, said object support member having on said inner rim a series of spaced, V-shaped drainage notches which flank said circular opening.

23. The hanger-assembly of claim 22, said object support member being constructed of metal.

24. The hanger-assembly of claim 17, said object support member being constructed of metal.

25. The hanger-assembly of claim 10, said object support member being constructed of metal.

26. A hanger-assembly for suspending potted plants or similar ornamentation from chain-link, lattice, privacy, or like fencing, comprising:

a generally U-shaped rod defined by spaced, upwardly extending legs joined at the bottom by a bite leg, the upper end of each of said legs being bent into a hook;

an object support member joined to said U-shaped rod at the bite leg thereof and extending generally laterally away from the plane of said upwardly extending legs, said object support member having a substantially dish-shaped configuration, comprised of two spaced, concentric rims, one inner and one outer, connected by a downwardly sloping, annular wall.

27. The hanger-assembly of claim 26, said inner rim circumscribing a circular opening in the bottom of said substantially dish-shaped object support member.

28. The hanger-assembly of claim 27, said object support member having on said inner rim a series of spaced, V-shaped drainage notches which flank said circular opening.

29. The hanger-assembly of claim 28 in which said outer rim extends towards said bite leg of said rod in a generally flat wall, said wall having spaced, parallel structural support ribs located therein.

30. The hanger-assembly of claim 29, said object support member being constructed of metal.

* * * * *